US005526548A

United States Patent [19]

Ostrowski

[11] Patent Number: 5,526,548

[45] Date of Patent: Jun. 18, 1996

[54] ERASER HOLDER

[76] Inventor: Joseph T. Ostrowski, 1091 Amboy Ave., Edison, N.J. 08837-2848

[21] Appl. No.: 562,550

[22] Filed: Nov. 24, 1995

[51] Int. Cl.[6] ..... B43L 19/00; B43K 29/02

[52] U.S. Cl. ..... 15/431; 15/425

[58] Field of Search ..... 15/105.51, 424, 15/425, 426, 427, 428, 429, 430, 431, 432, 433, 434, 105.52, 105.53

[56] References Cited

U.S. PATENT DOCUMENTS

| | | | |
|---|---|---|---|
| 795,500 | 7/1905 | Faber | 15/432 |
| 809,056 | 1/1906 | Hayes | 15/430 |
| 840,372 | 1/1907 | Reckendorfer | 15/432 |
| 1,237,013 | 8/1917 | Boos | 15/431 |
| 1,662,474 | 3/1928 | Randall | 15/429 |
| 2,099,613 | 11/1937 | Loewus | 15/424 |
| 2,144,014 | 1/1939 | Finck | 15/430 |
| 2,464,436 | 3/1949 | Cox | 15/434 |

FOREIGN PATENT DOCUMENTS

| | | | |
|---|---|---|---|
| 2617094 | 12/1988 | France | 15/424 |

*Primary Examiner*—David Scherbel
*Assistant Examiner*—Randall E. Chin

[57] ABSTRACT

An improved eraser holder on a pencil includes an eraser support band which can be removed in incremental sections to provide access to additional portions of the eraser after the original exposed portion has been worn down. Fracture lines on the band facilitate incremental removal of the sections, and the fracture lines are axially misaligned to strengthen the holder.

3 Claims, 2 Drawing Sheets

ERASER HOLDER

BACKGROUND OF THE INVENTION

1. Field of the Invention

The present invention relates to erasers and more particularly pertains to an eraser holder fixedly securable to the end of a writing instrument such as a pencil.

2. Description of the Prior Art

As is well known in the prior art, a pencil usually provides means for both writing and erasing. More particularly, a wooden pencil usually includes an eraser at one end thereof, and the eraser is contained within a band designed to support its engagement with the pencil. As the eraser wears down however, the band support serves little purpose and eventually, the band prevents access to an additional eraser portion after the eraser has been worn down to a top edge of the band. Unfortunately, no means have been developed to remove the unnecessary portion of the band so as to access additional sections of an eraser contained therein. If such a band could be removed when not needed, possibly in small increments, the possibility of accessing the remaining portion of a pencil eraser could be realized. As such, there appears to be a continuing need for an improved eraser band configuration that would enable a person to use more of the eraser once it has been worn down to the band. In this respect, the present invention substantially addresses this problem.

SUMMARY OF THE INVENTION

In view of the foregoing disadvantages inherent in the known types of eraser holders now present in the prior art, the present invention provides a new eraser holder wherein the same can be utilized to allow ongoing access to an eraser contained therein, while at the same time operating to support a much larger eraser on a pencil. As such, the general purpose of the present invention, which will be described subsequently in greater detail, is to provide an eraser holder and method which has many of the advantages of the eraser holders mentioned heretofore and many additional novel features that result in an eraser holder which is not anticipated, rendered obvious, suggested, or even implied by any of the prior art eraser holders, either alone or in any combination thereof.

To attain this, the present invention generally comprises an improved eraser holder on a pencil includes an eraser support band which can be removed in incremental sections to provide access to additional portions of the eraser after the original exposed portion has been worn down. Fracture lines on the band facilitate incremental removal of the sections, and the fracture lines are axially misaligned to strengthen the holder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new eraser holder and method which has many of the advantages of the eraser holders mentioned heretofore and many novel features that result in an eraser holder which is not anticipated, rendered obvious, suggested, or even implied by any of the prior art eraser holders, either alone or in any combination thereof.

It is another object of the present invention to provide a new eraser holder which may be easily and efficiently manufactured and marketed.

It is a further object of the present invention to provide a new eraser holder which is of a durable and reliable construction.

An even further object of the present invention is to provide a new eraser holder which is susceptible of a low cost of manufacture with regard to both materials and labor, and which accordingly is then susceptible of low prices of sale to the consuming public, thereby making such eraser holder economically available to the buying public.

Still yet another object of the present invention is to provide a new eraser holder which provides in the apparatuses and methods of the prior art some of the advantages thereof, while simultaneously overcoming some of the disadvantages normally associated therewith.

Still another object of the present invention is to provide a new and improved eraser holder which facilitates the use of removable sections which progressively expose additional portions of an eraser retained therein.

Yet another object of the present invention is to provide a new and improved eraser holder which allows the use of a much larger eraser on a pencil while also providing access to the complete eraser in a progressive manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF PREFERRED EMBODIMENTS

Figure 1:
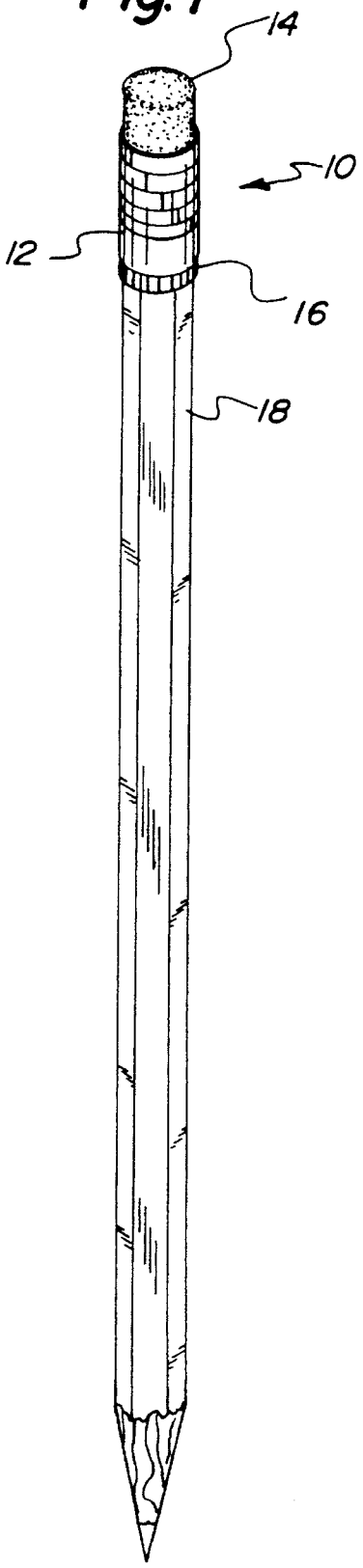
FIG. 1 is a perspective view of a pencil having the improved eraser holder comprising the present invention attached thereto.
Figure 2:
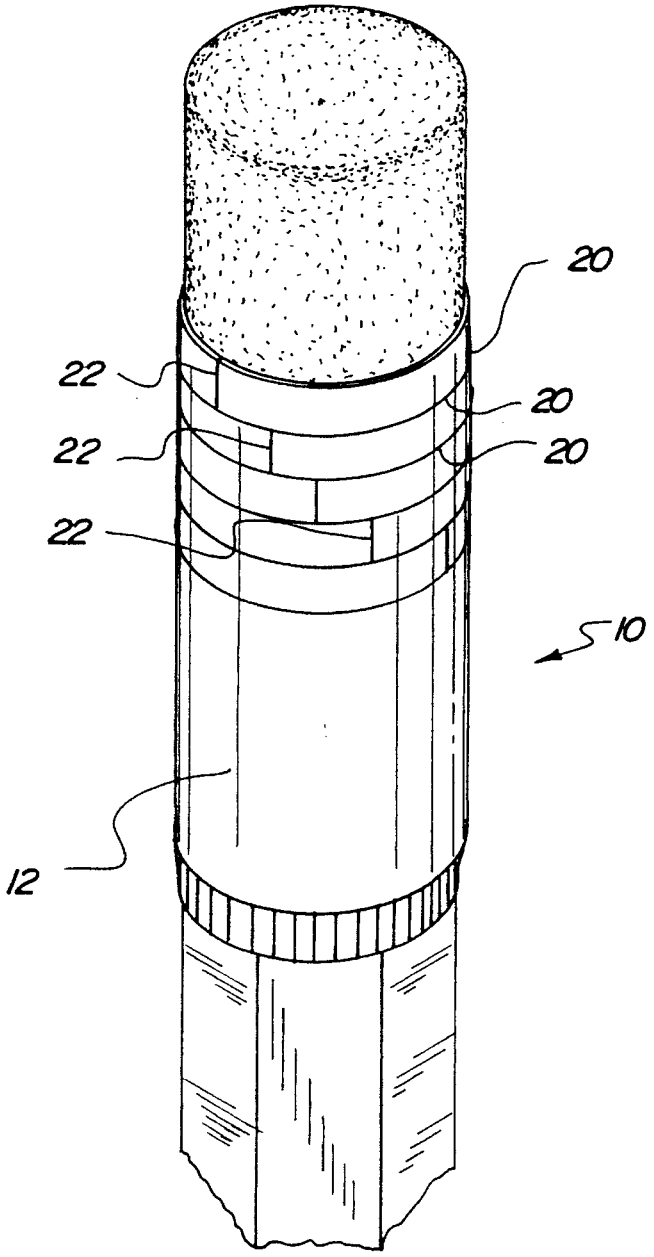
FIG. 2 is an enlarged perspective view of the eraser holder comprising the present invention.

With reference now to the drawings, and in particular to FIGS. 1 and 2 thereof, a new eraser holder embodying the principles and concepts of the present invention and generally designated by the reference numeral 10 will be described.

More specifically, it will be noted that the eraser holder 10 essentially includes a tubular eraser holder 12 of a metallic construction with an elongated cylindrically-shaped eraser 14 contained therein. The eraser holder 12 includes a bottommost clamping band 16 which facilitates its attachment to a conventional wooden pencil 18 in a well known manner, and the eraser 14 initially extends out of the eraser holder 12 by a predetermined amount which will facilitate its selective use as desired.

The elongated tubular eraser holder 12 is provided with a plurality of circumferentially extending scores or fracture lines, each of which is generally designated by the reference numeral 20. These scores 20 are aligned and spaced apart by a predetermined amount. Additionally, each score extends completely around a peripheral surface of the holder 12 and effectively constitutes a weakened area which will allow a fracturing to occur by minimal manual pressure.

The eraser holder 12 further includes a plurality of axially aligned scores, each of which is generally designated by the reference numeral 22, and no two of which lie on the same axial line. Each axial score 22 extends between a juxtaposed set of scores 20, and they similarly represent lines of selective fracture associated with the eraser holder 12. Inasmuch as all of the scores 20, 22 represent weakened areas to facilitate selective fracture of the eraser holder 12, by misaligning the scores 22 in the illustrated manner, additional strength is imparted to the holder 12 whereby an increased length of eraser 14 can be utilized in the holder.

Figure 3:
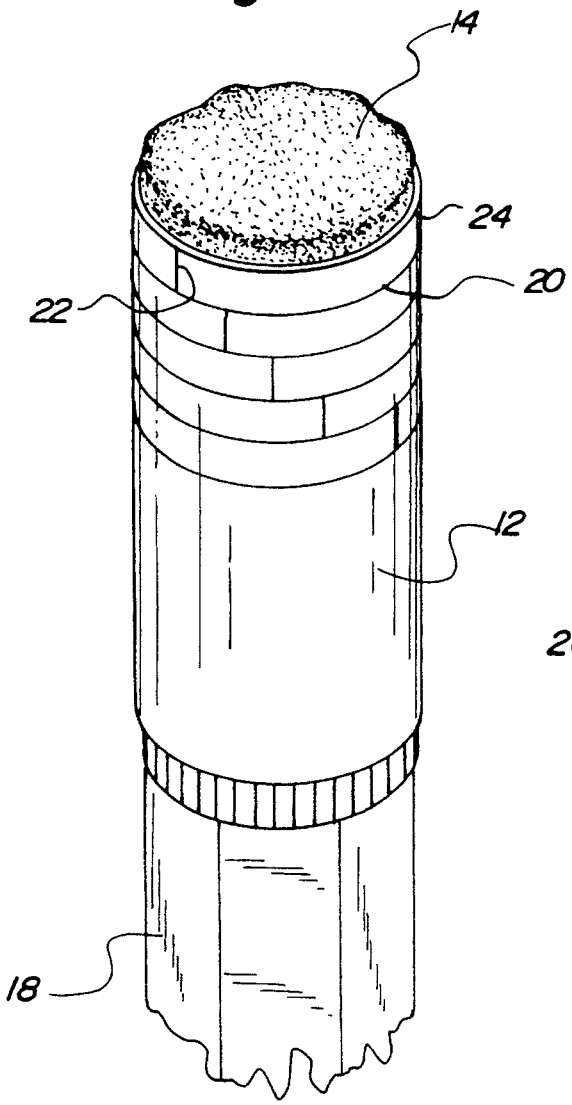
FIG. 3 is a perspective view of the eraser holder illustrating the depletion of an exposed portion of eraser.
Figure 4:
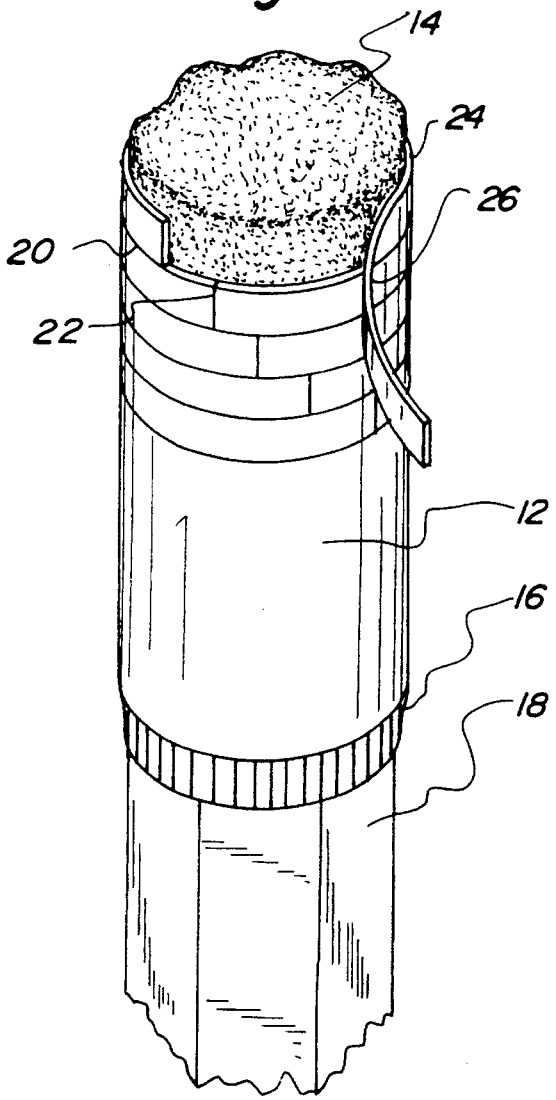
FIG. 4 is a perspective view illustrating the manner of use of the present invention.

FIGS. 3 and 4 of the drawings illustrate both the novelty and utility of the eraser holder 10 which comprises the present invention. In this respect, FIG. 3 illustrates how the eraser 14 will eventually be worn down so as to be in a close abutting relationship with a top edge 24 of the holder 12. This is the situation that is typically encountered with conventional pencils 18, i.e., once the eraser 14 reaches the top edge 24 of a holder 12, the rest of the eraser contained within the holder is no longer accessible or usable.

FIG. 4 illustrates how the score lines 20, 22 facilitate access to additional portions of the eraser 14 once it has been worn down to a top edge 24. In this respect, a user can insert his fingernail between the top edge 24 of the holder 12 and the eraser 14, and in the vicinity of the topmost axial score 22. With minimal finger pressure then, the score 22 will fracture, and a topmost strip 26 of the holder 12 can be peeled off in the illustrated manner. The removal of the top strip 26 is accomplished by the subsequent fracturing of the first circumferential score 20 and as shown, an additional portion of the eraser 14 is thus exposed for use. Once this additional portion of the eraser 14 is worn down to a new top edge 24, an additional strip 26 of holder 12 can be peeled off to reveal even more of the eraser. Accordingly, depending upon the number of circumferential scores 20, virtually all of an eraser 14 within a holder 12 can be accessed, thereby to eliminate the normal wastage of erasers concealed within holders on conventional pencils 18.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved eraser assembly for use with a writing instrument comprising;

a tubular eraser;

a tubular eraser holder, said eraser being substantially retained within said eraser holder so as to be selectively useable with said writing instrument;

said eraser holder including eraser holder adjustment means for selectively shortening said eraser holder to thereby expose additional portions of said eraser as needed, said means defined by a plurality of scores defining selectively removable disposable eraser holder sections which allow said eraser holder sections to be manually fractured and selectively removed from said eraser holder to shorten said eraser holder and thereby expose additional portions of said eraser, said scores consisting of a plurality of parallelly aligned circumferential shallow cuts extending completely around said eraser holder, each of said circumferential shallow cuts being intersected by axially extending scores whereby each of eraser holder sections may be fractured from said eraser holder in both axial and circumferential directions thereby facilitating a progressive removal of each section;

wherein only one axially extending score is positioned between each juxtaposed, parallel set of circumferential cuts and wherein all axially extending scores are misaligned relative to each other, whereby no two axially scores lie on the same axial line, thereby to provide increased strength to said eraser holder to thus permit a retention of a much longer eraser in engagement with said writing instrument.

2. The new and improved eraser assembly for use with a writing instrument as described in claim 1 wherein said eraser holder is of a metallic construction.

3. The new and improved eraser assembly for use with a writing instrument as described in claim 1 wherein said writing instrument is a pencil.

* * * * *